US007184268B2

(12) United States Patent
Espinoza-Ibarra et al.

(10) Patent No.: US 7,184,268 B2
(45) Date of Patent: Feb. 27, 2007

(54) DYNAMICALLY ADAPTABLE ELECTRONICS COOLING FAN

(75) Inventors: Ricardo Espinoza-Ibarra, Lincoln, CA (US); Glenn Simon, Auburn, CA (US); Christopher Gregory Malone, Loomis, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 37 days.

(21) Appl. No.: 11/033,083

(22) Filed: Jan. 10, 2005

(65) Prior Publication Data

US 2006/0152901 A1 Jul. 13, 2006

(51) Int. Cl.
*H05K 7/20* (2006.01)

(52) U.S. Cl. ..... 361/695; 361/82; 165/121; 415/125; 415/191; 415/199.5; 416/136

(58) Field of Classification Search ..... 361/683, 361/687, 692, 695, 714, 719, 724, 727; 454/184; 165/80.3, 185, 104.33; 415/1, 68, 141, 25, 415/36, 37; 416/142, 143, 44, 45, 51, 53, 416/178, 186 A, 88, 5, 223 B, 146 R, 170 R, 416/210 R See application file for complete search history.

(56) References Cited

U.S. PATENT DOCUMENTS

| | | | | |
|---|---|---|---|---|
| 3,580,694 | A * | 5/1971 | Andersen et al. | 416/136 |
| 5,617,817 | A | 4/1997 | Martin | |
| 5,701,045 | A | 12/1997 | Yokozawa et al. | |
| 5,722,523 | A | 3/1998 | Martin | |
| 5,835,786 | A | 11/1998 | Brown et al. | |
| 5,848,678 | A | 12/1998 | Johnston et al. | |
| 5,879,141 | A | 3/1999 | Yokozawa et al. | |
| 5,896,964 | A | 4/1999 | Johnston et al. | |
| 5,896,965 | A | 4/1999 | Gopalswamy et al. | |
| 5,947,248 | A | 9/1999 | Link | |
| 6,118,658 | A | 9/2000 | Nakase | |
| 6,129,193 | A | 10/2000 | Link | |
| 6,199,391 | B1 | 3/2001 | Link et al. | |
| 6,331,743 | B1 | 12/2001 | Link | |
| 6,386,826 | B1 * | 5/2002 | Jacob | 415/125 |
| 6,474,936 | B1 * | 11/2002 | deBlanc et al. | 415/25 |
| 6,547,519 | B2 * | 4/2003 | deBlanc et al. | 415/141 |
| 6,634,476 | B2 | 10/2003 | Inoue et al. | |
| 6,732,845 | B2 | 5/2004 | Tilly et al. | |
| 6,767,186 | B2 * | 7/2004 | Olesiewicz | 416/136 |
| 2003/0192763 | A1 | 10/2003 | Inoue et al. | |
| 2004/0101404 | A1 | 5/2004 | Takemoto | |
| 2004/0118656 | A1 | 6/2004 | Inoue et al. | |

FOREIGN PATENT DOCUMENTS

| | | | |
|---|---|---|---|
| GB | 503113 A | | 3/1939 |
| GB | 628345 A | | 8/1949 |
| GB | 825120 A | | 12/1959 |
| GB | 1242119 A | | 8/1971 |
| GB | 1259367 A | | 1/1972 |
| GB | 2153014 A | | 8/1985 |
| JP | 401195999 A | * | 8/1989 |
| JP | 06029682 A | * | 2/1994 |
| JP | 410141283 A | * | 5/1998 |

* cited by examiner

*Primary Examiner*—Michael Datskovskiy

(57) ABSTRACT

In an electronic system, a method for operating a cooling fan comprises rotating an impeller about a rotational axis and detecting fan failure. The impeller is spatially expanded in response to the detected fan failure whereby airflow through the failed fan is blocked.

22 Claims, 10 Drawing Sheets

DYNAMICALLY ADAPTABLE ELECTRONICS COOLING FAN

BACKGROUND OF THE INVENTION

Electronic systems and equipment such as computer systems, network interfaces, storage systems, and telecommunications equipment are commonly enclosed within a chassis, cabinet or housing for support, physical security, and efficient usage of space. Electronic equipment contained within the enclosure generates a significant amount of heat. Thermal damage may occur to the electronic equipment unless the heat is removed.

Re-circulation of heated air can impact performance of electronic equipment. If airflow patterns allow re-usage of air that is previously heated by electronic equipment component to attempt to cool electronic equipment, less effective heat transfer from the equipment to the cooling airflow can result. In some circumstances insufficient heat transfer can take place and the equipment may overheat and potentially sustain thermal damage.

One re-circulation scenario occurs when a fan fails and hot air exhausted from other vents in the system may re-circulate back to the vicinity of the failed fan, greatly impacting thermal management for device.

SUMMARY

In accordance with an embodiment of an electronic system, a method for operating a cooling fan comprises rotating an impeller about a rotational axis and detecting fan failure. The impeller is spatially expanded in response to the detected fan failure whereby airflow through the failed fan is blocked.

BRIEF DESCRIPTION OF THE DRAWINGS

Embodiments of the invention relating to both structure and method of operation, may best be understood by referring to the following description and accompanying drawings whereby.

DETAILED DESCRIPTION

An electronics cooling fan dynamically responds to a failure condition by expanding structural fan members, blocking airflow and reducing or preventing recirculation of heated air.

Figure 1A:
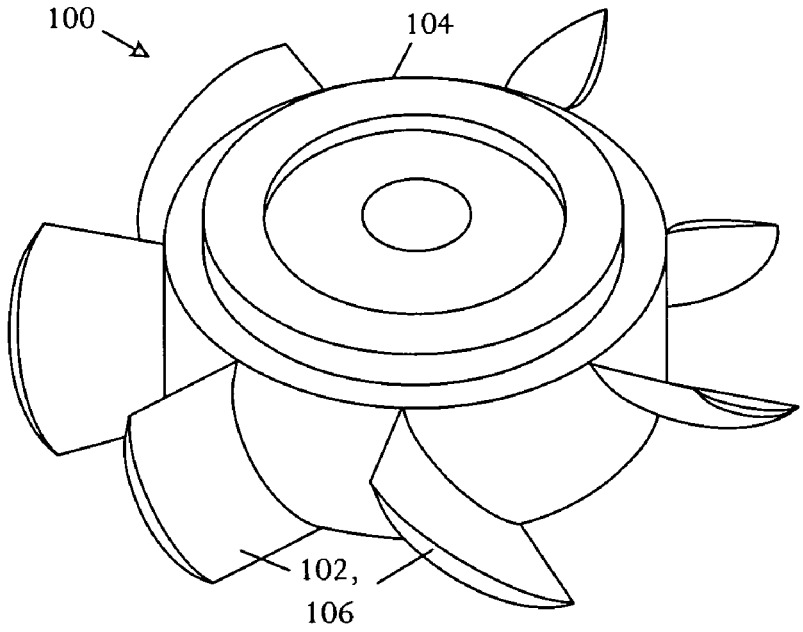
FIGS. 1A and 1B are perspective pictorial diagrams illustrating an embodiment of an electronics cooling fan adapted to control air flow by selectively varying the thickness of structures within the air flow pathway.
Figure 1B:
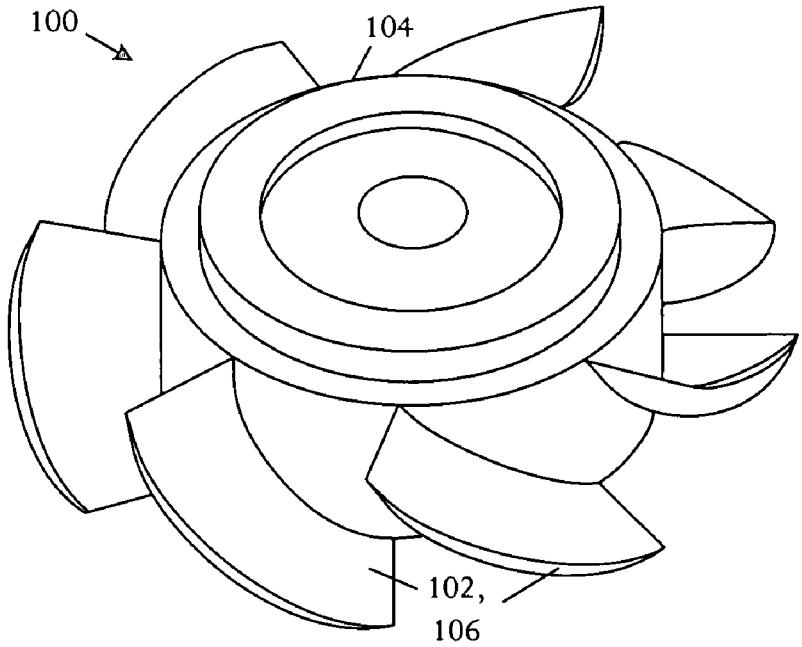

Referring to FIGS. 1A and 1B, perspective pictorial diagrams illustrate an embodiment of an electronics cooling fan 100 adapted to control air flow by selectively varying the thickness of structures within the air flow pathway. The electronics cooling fan 100 is arranged in a configuration adapted for rotational motion which generates an axial airflow pathway. The electronics cooling fan 100 comprises a member 102 arranged within the axial airflow pathway that is adapted to spatially expand when the rotational motion slows or terminates.

The electronics cooling fan 100 is configured to prevent airflow recirculation in a system when a fan fails. Various other techniques can be used to prevent or reduce airflow recirculation. For example, flexible air flow blockers can be added to the fans such that if one fan fails, the blocker flexes in a direction opposite to the flow of air, thereby preventing air from being sucked back through the failed fan and re-circulated through the system. A limitation of the technique is that the airflow blocker interferes with the airflow generated by the running fan, hindering fan performance so that the system is not cooled as well as possible. Usage of airflow blockers also increases the system cost because more exotic flexible materials are commonly used to enable blocking. Another cost results from the reduction in cooling efficiency, elevating the energy expenditure of the system.

In an illustrative embodiment, the electronics cooling fan 100 typically has a rotor 104 adapted for rotational motion and an impeller 106 coupled to the rotor 104 and adapted to spatially expand when the rotational motion slows or terminates.

FIG. 1A depicts the size of the members 102 when the electronics cooling fan 100 is rotating at an operational speed. FIG. 1B shows the expanded members 102 when fan rotation slows or ceases.

The illustrative electronics cooling fan 100 enables multiple fans to coexist in parallel such that if one or more fans fail, the failure does not function as a bleeding hole through which air can be sucked by the fans that remain running and air is re-circulated through the system.

Figure 2A:
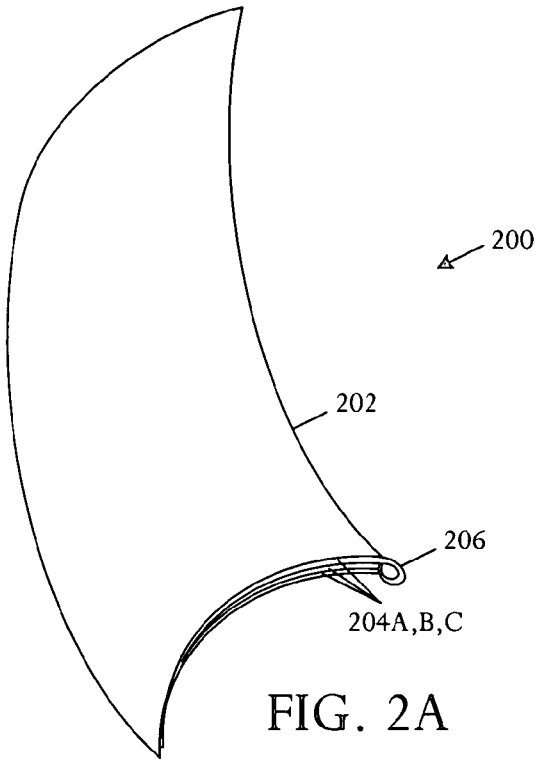
FIGS. 2A and 2B are perspective pictorial diagrams depicting an embodiment of an electronics cooling fan that uses electromagnetic members to control air flow by selectively varying the thickness of structures within the air flow pathway.
Figure 2B:
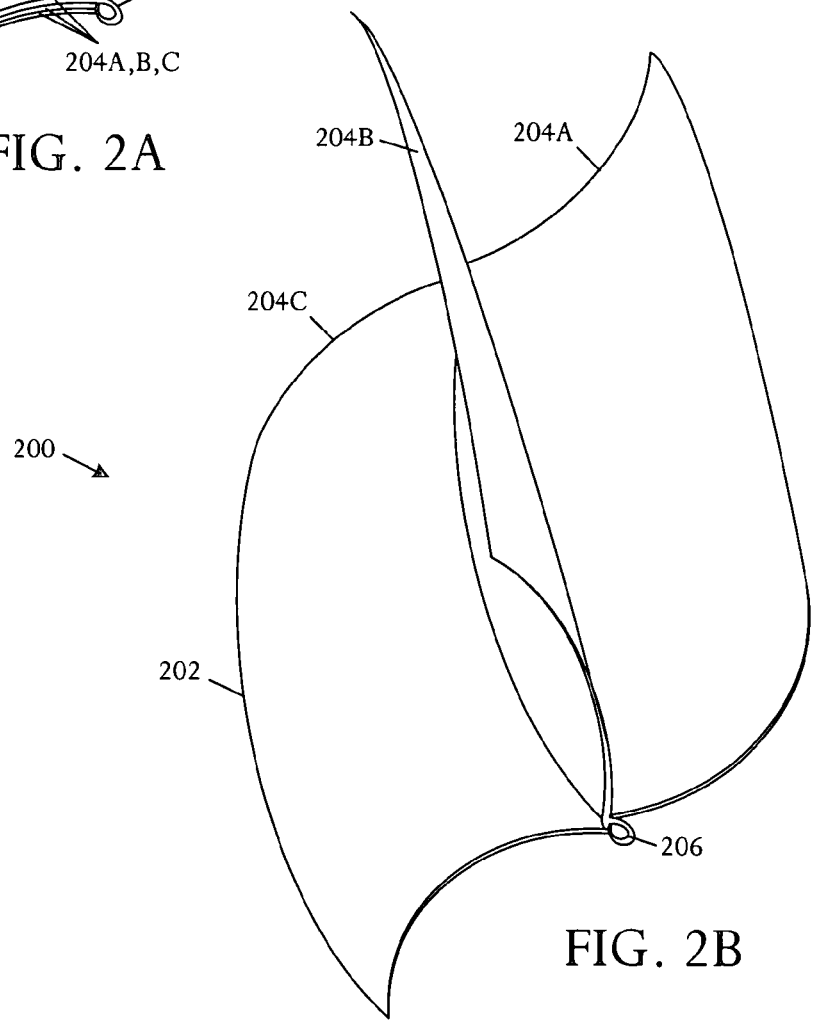

Various different structures and techniques can be used to form a member 102 which is selectively expanded and contracted. The structures and techniques enable fan blades to expand and occupy more space once a fan stops running. FIGS. 2A and 2B are pictorial diagrams illustrating an embodiment of a fan structure 200 that can be attached to a rotor configured for rotational motion, and multiple fan blades 202 coupled to the rotor. The individual fan blades 202 include multiple blade electromagnetic segments 204A, B, C which mutually attract during rotation as shown in FIG. 2A, and mutually repel when the rotational motion slows or terminates, depicted in FIG. 2B. In the example, the multiple blade electromagnetic segments 204A, B, C are connected at a hinge 206. In other embodiments, the segments may be connected using other structures.

The individual fan blades 202 can be constructed from multiple smaller pieces. The illustrative embodiment uses blades with three component pieces, although other embodiments may have more or fewer segments. The segments 204A, B, C are magnetically coupled by applying a small current through the individual segments, generating a magnetic field that is opposite in polarity from the magnetic field in the other segments. The attraction of opposite polarities causes the separate segments to mutually attract, thereby forming an overall fan blade profile of a usual or normal operational blade size. If a fan fails or stops, the current flowing through the segments 204A, B, C moves in the same direction, causing magnetic fields of the same polarity so the segments mutually repel, increasing the effective blade profile. All fan blades 202 attached to the rotor expand due to the electromagnetic effects, causing the fan to become effectively blocked so that no air flows through the fan.

The electromagnet is simply formed by applying a voltage across conductors in the blade segments 204A, B, C.

Figure 3A:
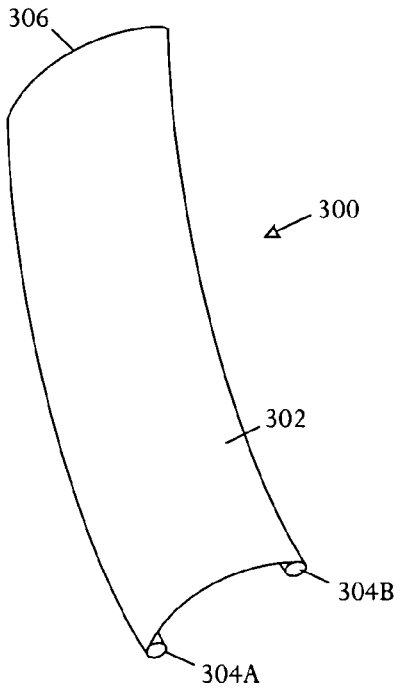
FIGS. 3A and 3B are perspective pictorial diagrams depicting an embodiment of an electronics cooling fan that uses separable members connected by a membrane to control air flow by selectively varying the thickness of structures within the air flow pathway.
Figure 3B:
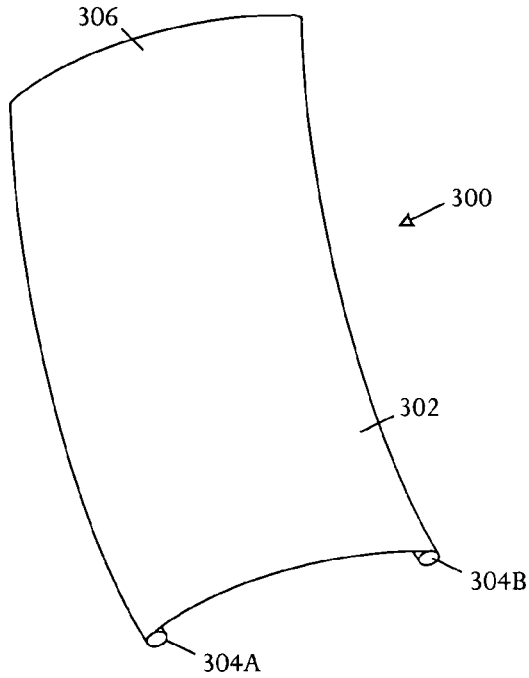

FIGS. 3A and 3B are pictorial diagrams showing an embodiment of a fan structure 300 that can be attached to a rotor configured for rotational motion and one or more fan blades 302 attached to the rotor. The individual fan blades 302 further include two or more blade members 304A, B and a flexible membrane 306 coupled between the blade members 304A, B. Positioning of the two or more blade members 304A, B is controlled to converge during rotation as shown in FIG. 3A, and to diverge when the rotational motion slows or terminates, depicted in FIG. 3B.

In another embodiment, two blade members may be attached in an arrangement with the members attached at an angle a selected number of degrees from one another to form, in combination, a single fan blade. For example, the members typically include a leading member and a following member with a membrane extending between the members. The following member pushes the leading member so that, when a motor begins spinning and moving the fan blade, the following member pushes the leading member. The membrane is composed of an expanding material with a low K constant such that the membrane easily stretches.

Some fans include an airflow stabilizer that is typically part of a fan support assembly. The airflow stabilizer guides a cone of air generated by the fan and is focused in a desired direction. The airflow stabilizer can be constructed from multiple pieces so that when the fan stops, a detection circuit causes the airflow guide to expand or open, for example in the manner of a Chinese fan, and block the fan completely.

Referring to FIGS. 4A through 4F, multiple perspective pictorial diagrams illustrate an embodiment of an electronics cooling fan 400 that uses extendable flaps to control air flow by selectively varying the thickness of structures within the air flow pathway.

The fan 400 includes an airflow stabilizer 408 adapted to direct airflow through the electronics cooling fan 400. The airflow stabilizer 408 includes multiple members 410 that contract during rotational motion and expand when the rotational motion slows or terminates, constricting the airflow through the fan 400.

The electronics cooling fan 400 includes a stator 404 and a rotor 406 arranged in combination with the stator 404 and adapted for rotational motion. Multiple fan blades 402 are attached to the rotor 406. Multiple stator blades 412 are attached to the stator 402. The individual stator blades 412 include a flap 414 pivotally coupled to the stator blade 412 by a hinge pin 416. The flap 414 is configured to abut the stator blade 412 during rotation and extend from the stator blade 412 when the rotational motion slows or terminates.

FIGS. 4A through 4F depict an embodiment of the fan 400 that restricts flow on failure of the fan 400 or a motor driving the fan. The fan 400 is useful in systems with cooling components configured with fans arranged in parallel to prevent or reduce recirculation of air through a failed fan, for example if only one of two fans is operational. The flaps 414 in the fan 400 close, for example with flaps 414 extending upward, due to air pressure which otherwise induces air to flow backwards through the failed fan. In normal operation, when the fan is working, the flaps 414 are in the open position, for example with flaps extending downward.

Figure 4A:
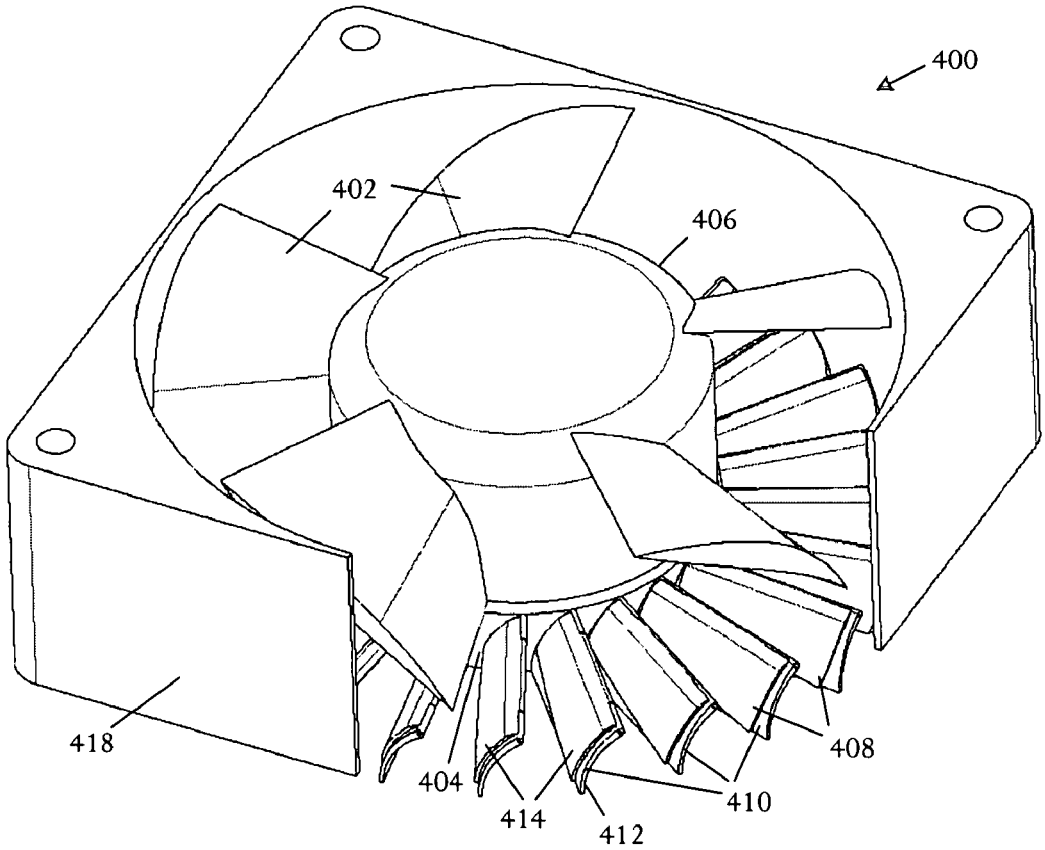
FIGS. 4A through 4F depict multiple perspective pictorial diagrams illustrating an embodiment of an electronics cooling fan that uses extendable flaps to control air flow by selectively varying the thickness of structures within the air flow pathway.
Figure 4B:
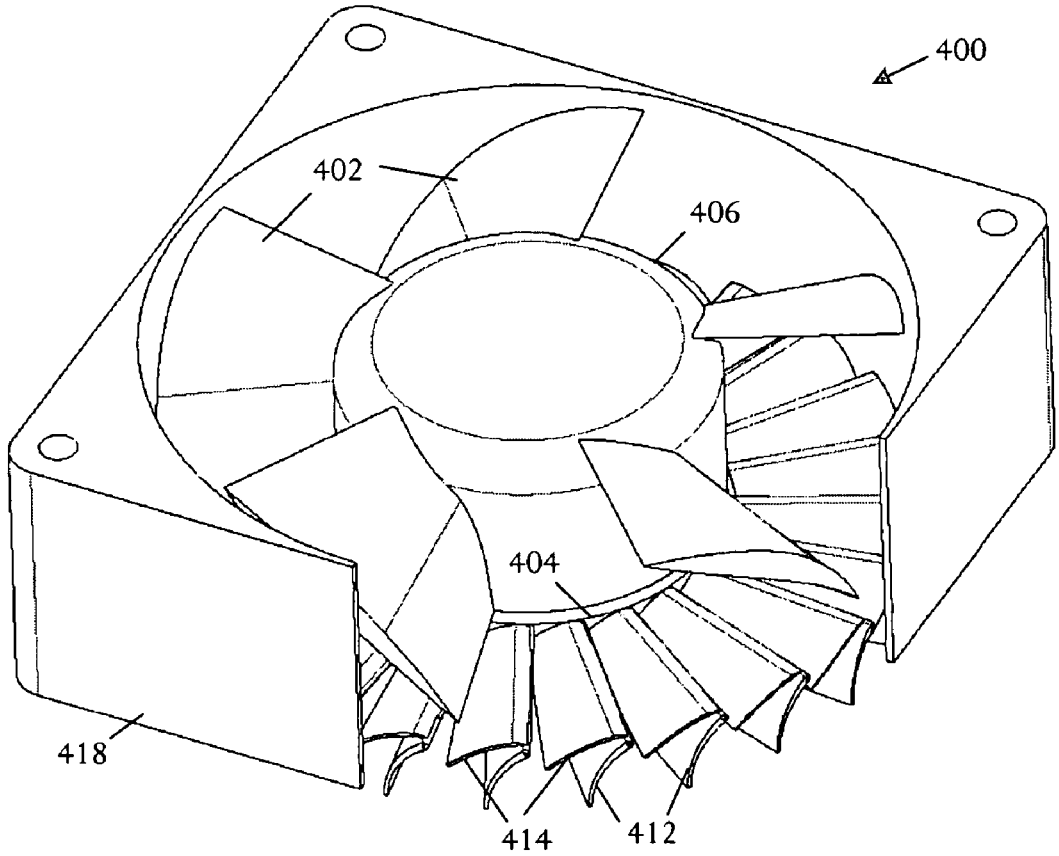
Figure 4C:
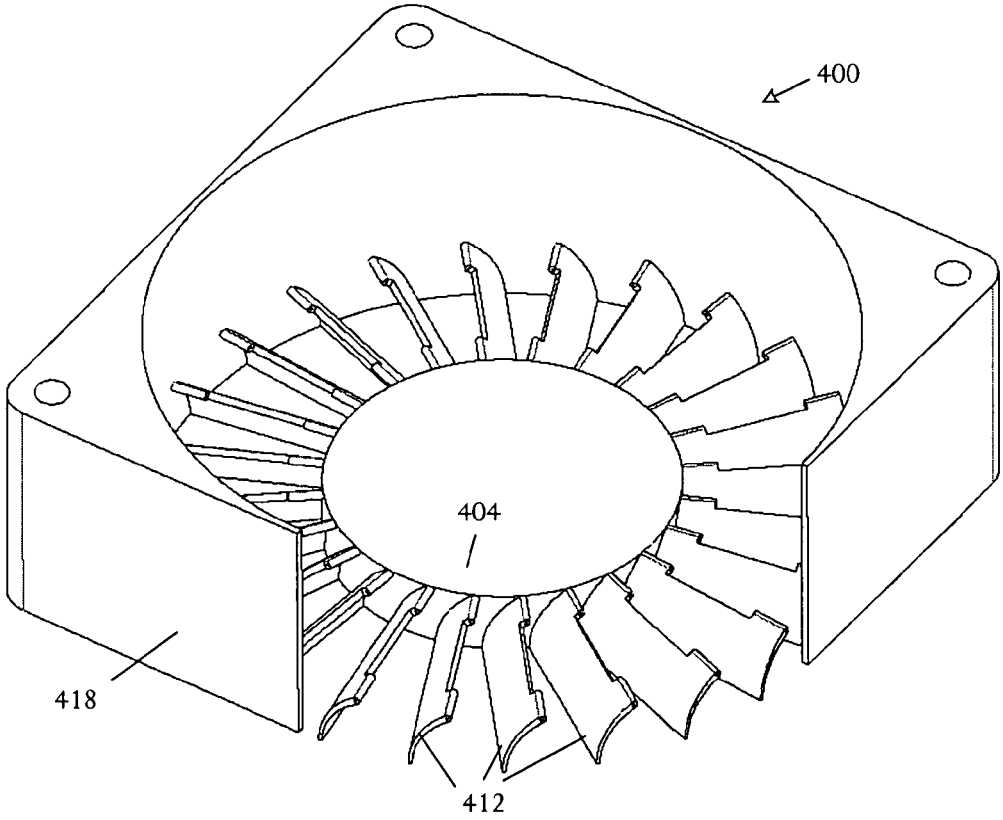
Figure 4D:
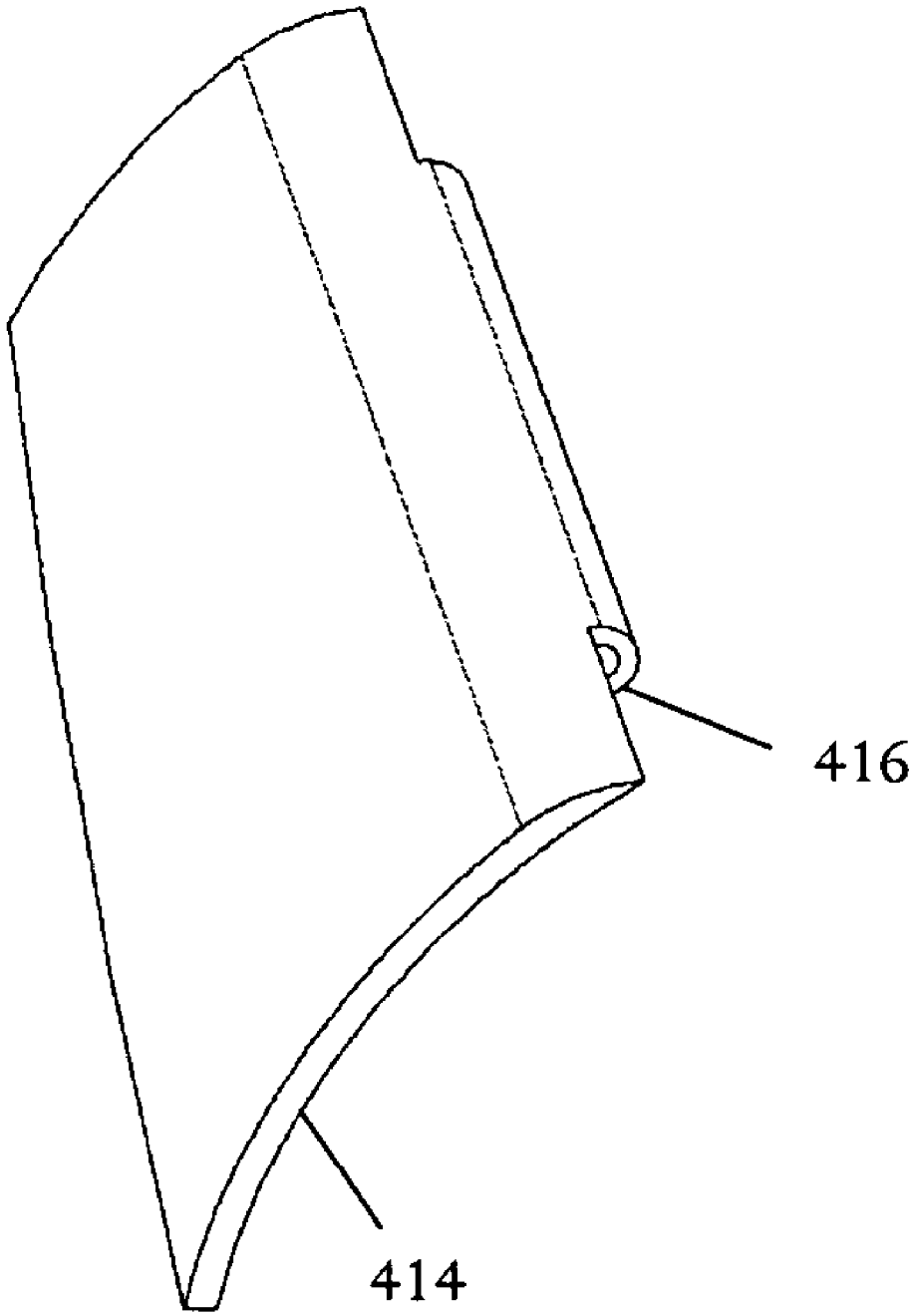
Figure 4E:
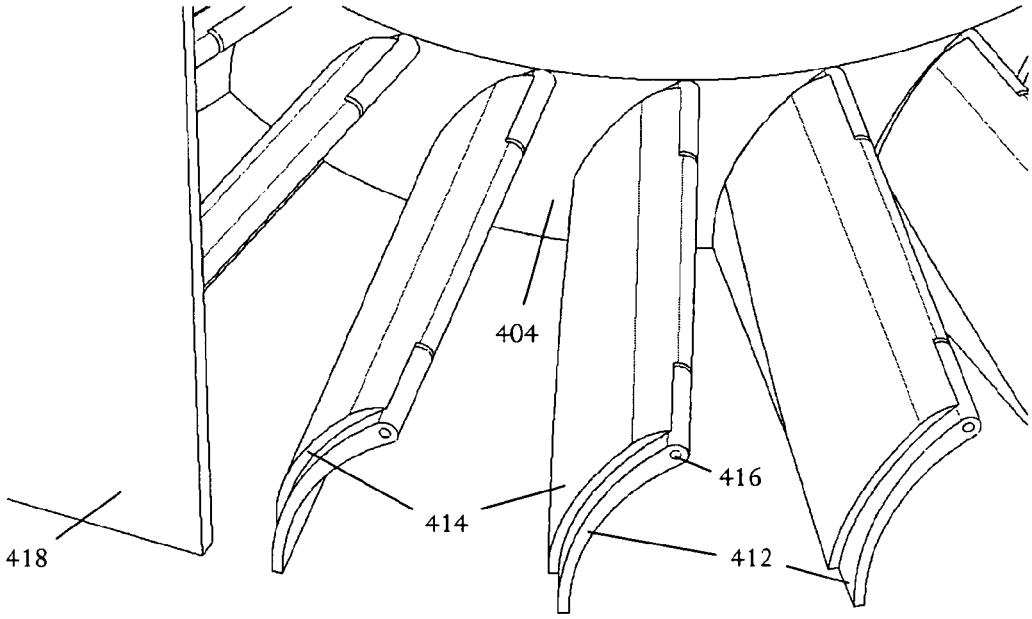
Figure 4F:
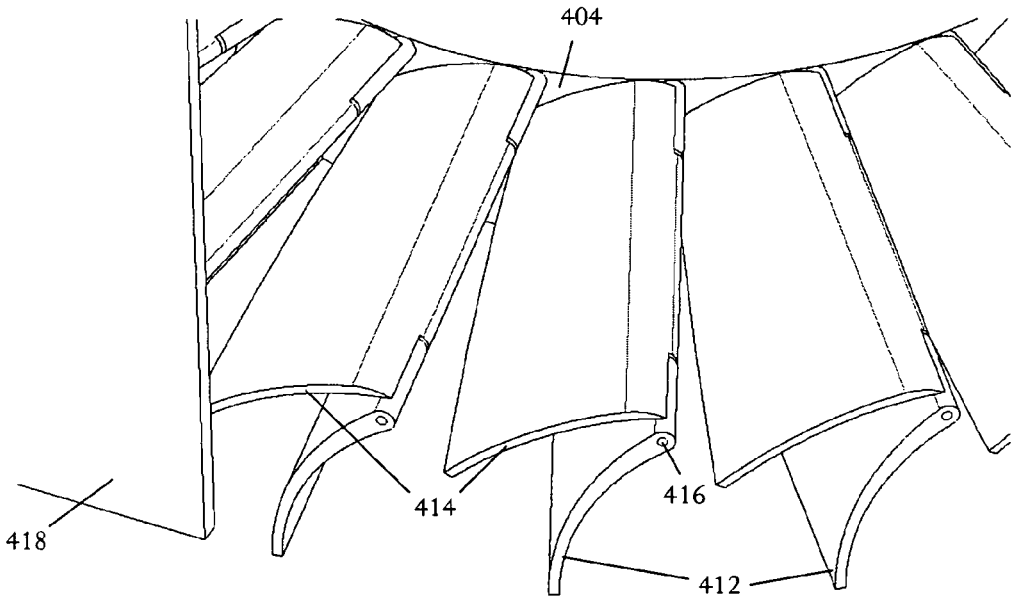

FIG. 4A depicts the fan assembly 400 with flaps 414 extending downward, with the fan operational. FIG. 4B shows the fan assembly 400 with flaps 414 in the upward configuration, the arrangement occurring with a failed fan. FIG. 4C shows the fan housing 418 with fixed stator blades 412. FIG. 4D illustrates a close-up view of the flap 414 which connects to each stator blade 412 via a hinge pin 416. FIG. 4E shows a close-up view of flaps 414 in the down position. FIG. 4F shows a close-up view of the flaps 414 in the up position.

Figure 5:
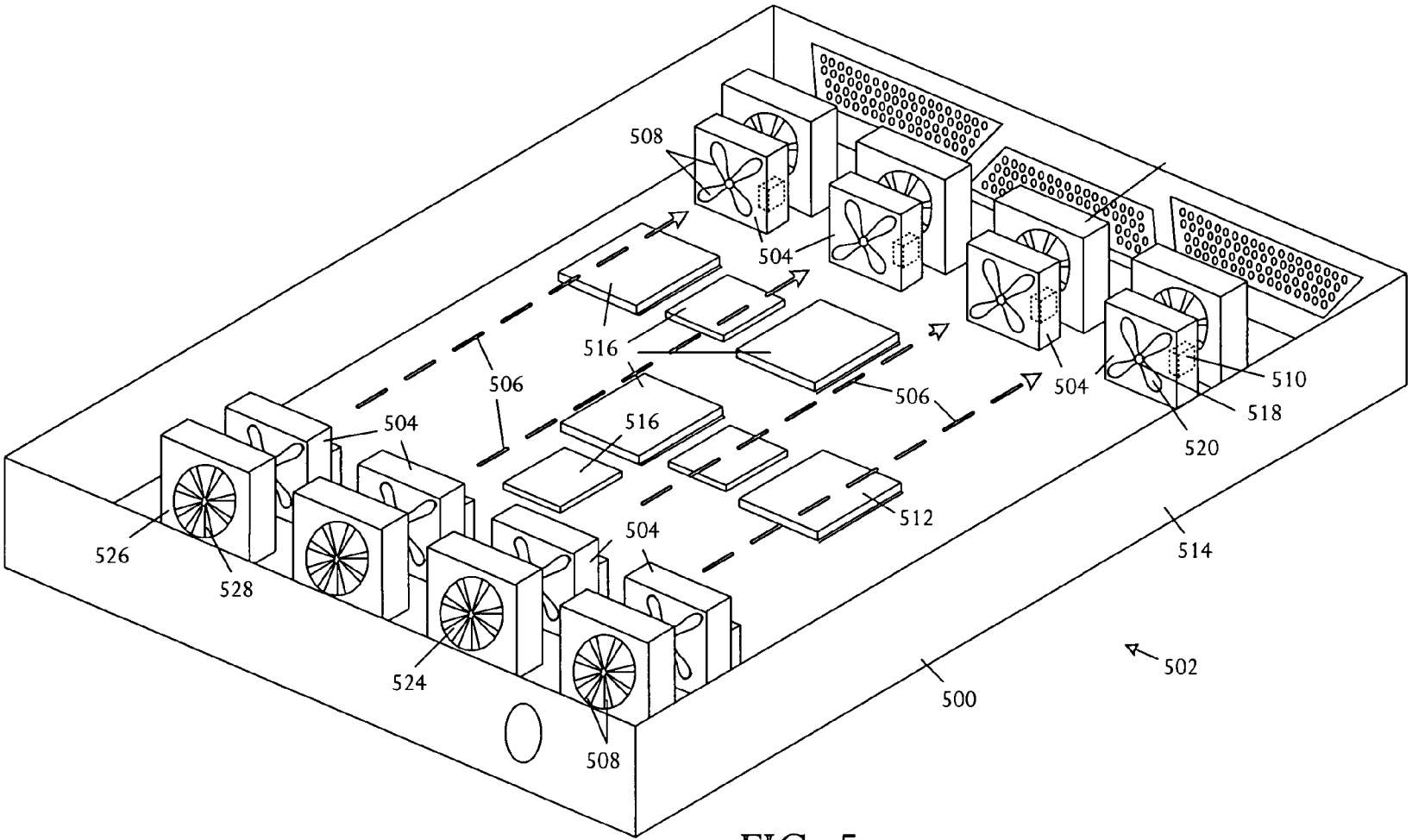
FIG. 5 is a perspective pictorial diagram showing an embodiment of an electronic system that may use the illustrative cooling fans.

Referring to FIG. 5, a perspective pictorial diagram shows an embodiment of an electronic system 500 including an electronics cooling apparatus 502 adapted to block airflow through a fan 504 in response to fan failure. The electronic system 500 comprises a chassis 514 and a plurality of electronics cooling fans 504 contained within the chassis 514 arranged to generate cooling airflow over one or more electronic components 516. The electronics cooling fans 504 are adapted for rotational motion generating an axial airflow pathway 506. The electronics cooling fans 504 further comprise one or more members 508 arranged within the axial airflow pathway 506 adapted to spatially expand upon fan failure. Various different structures and techniques may be used to prevent recirculation of air through a failed fan. Airflow is maintained in the pathway 506 by preventing backflow through any failing fan.

The illustration depicts an approximate visual description of fans and restrictors in relation to one another. An actual electronic system includes additional walls and ducts that channel airflow within the chassis 514 and eliminate gaps through which air can be recirculated. Also, in an actual electronic system 500 the cooling fans 504 and restrictor devices 526 are closely-coupled with no gaps or apertures that enable air leakage. Similarly, fans 504 are arranged with tight coupling, eliminating any unobstructed gaps that would allow recirculation. Typically, fans 504 are mounted on a sheet metal wall, for example a wall of the chassis 514 or barrier wall interior to the chassis so that air only passes through the fan, preventing air from flowing around the fans.

The electronics cooling fans 504 are configured for rotational motion which generates axial airflow in the pathway 506. The electronics cooling fans 504 may include one or more members 508 interposed within the axial airflow pathway that spatially expand upon fan failure.

The electronics cooling apparatus 502 may include a sensor 510 adapted to detect failure of an electronics cooling fan 504 and a logic 512, for example a processor or controller, that interacts with the sensor 510 and the electronics cooling fan 504. The logic 512 controls the fan response to fan failure detection by activating spatial expansion of the member 508.

In various embodiments, different types of sensors may be implemented. For example, typical sensor types include current sensors, sensors of other electrical parameters, temperature sensors, tachometer sensors, and the like.

In some example implementations, the sensor 510 may be a circuit that senses fan current across a resistor coupled to a power line to the fan 504. The resistor has a resistance selected based on fan current to develop a selected current drop. Fan failure detection is typically implemented by monitoring fan current waveform for shape and/or offset. A properly functioning fan generally has a characteristic movement. Therefore a circuit used to detect fan failure may be a "current-movement" detector that is insensitive to both offset and waveform. For example, a circuit such as a filtering circuit or transistor circuit may track oscillations in measured current. Normal fan operation is indicated by oscillations within a known pattern. Fan failure is indicated when the oscillations cease or fall outside the normal range.

Another type of sensor 510 is a monitor of the electrical level on the power line supplying the fan.

Some embodiments may include a sensor 510 in the form of a temperature sensor or switch. Fan failure detection may be indicated if an excessive temperature is reached for any reason.

Another sensor 510 may be a heater resistor that is positioned within the fan air stream and enables detection of changes in air stream temperature.

Some fans are equipped with locked-rotor sensing. If the rotor stops, the fan enters a shutdown mode and automatically attempts to restart at regular intervals.

Some implementations may use a tachometer sensor which senses fan revolutions and may assert an alert signal when fan speed falls below a user-programmable threshold or trip point. Fan speed falling below a programmable level may be indicative of fan wearing or a stuck rotor condition.

A particular sensor implementation may include multiple different sensor types.

In some implementations, the logic 512 controls rotation of a member 508 in the fan 504, thereby generating the axial airflow pathway 506. In response to fan failure, or slowing or termination of fan rotation, the logic 512 spatially expands the member, thereby blocking the airflow pathway 506.

In some embodiments, a fan 504 includes a rotor 518 adapted for rotational motion and one or more impellers 520 coupled to the rotor 518 and adapted to spatially expand upon fan failure detection. In such embodiments, the impeller 520 comprises a member 508 that expands or is expanded in the event of fan failure. Logic 512 may be configured to control rotation of the impeller 520 about a rotational axis. On detection of fan failure, the logic 512 spatially expands the impeller 520 in response to the detected fan failure, blocking airflow through the failed fan.

In some embodiments, a fan 504 includes the rotor 518 and multiple fan blades coupled to the rotor 518. The fan blades may have multiple blade electromagnetic segments configured to mutually repel upon fan failure detection and otherwise mutually attract. Logic 512 activates rotation of the blades and controls the current passing through the electromagnetic segments, including control of the current direction so that the blades mutually repel when the fan has failed and otherwise to mutually attract. In some embodiments, the sensor 510 detects rotation speed of the fan blades and the logic 512 passes current through the electromagnetic segments in a direction that causes the plurality of fan blades to mutually attract when the rotation speed is higher than a preselected value and to otherwise mutually repel.

In other embodiments, the fan blades may be in the form of two or more blade members and a flexible membrane coupled between the blade members. Separation between the two or more blade members is adapted to diverge upon fan failure detection and otherwise converge. Logic 512 controls rotation of the impellers and the angle of separation between the impeller members during rotation. Logic 512 typically maintains a small angle of separation between the impeller members and, upon detection of fan failure, increases the angular separation between the impeller members thereby blocking airflow through the failed fan. In some implementations, logic 512 detects the rotation speed of the blades and maintains separation of the blade members when the speed is above a preselected value. If the rotation speed falls below the value, the blade members are separated, blocking fan airflow.

In some embodiments, an airflow stabilizer 524 may be adapted to direct airflow through the electronics cooling fan 504. The airflow stabilizer 524 may include multiple members that expand upon fan failure detection, constricting the airflow through the electronics cooling fan 504. Otherwise, the multiple members contract. In such embodiments, the airflow stabilizer members operate as the expanding members 508 within the airflow pathway 506. In such implementations, logic 512 controls the configuration of the airflow stabilizer members, expanding the airflow stabilizer members 508 when the fan has failed so that airflow through the electronics cooling fan is constricted. Otherwise, logic 512 contracts the airflow stabilizer members.

In a particular implementation, fan operations can be monitored based on fan speed. Logic 512 may read a sensor such as a tachometer to determine rotation speed of the fan blades and control the airflow stabilization members accordingly. If rotation rate is above a preset level, airflow stabilization members can be contracted. For rotation speed below the selected value, the airflow stabilization members are expanded to reduce airflow through the fan.

In further additional embodiments, a fan 504 may include a stator 526 and a rotor 518 arranged in combination with the stator 526 and adapted for rotational motion. Multiple stator blades 528 are coupled to the stator 526. The individual stator blades 526 may include a flap that is pivotally coupled to the stator blade by a hinge pin. The flap abuts the stator blade 528 when the fan is operational and extends from the stator blade upon fan failure detection.

While the present disclosure describes various embodiments, these embodiments are to be understood as illustrative and do not limit the claim scope. Many variations, modifications, additions and improvements of the described embodiments are possible. For example, those having ordinary skill in the art will readily implement the steps necessary to provide the structures and methods disclosed herein, and will understand that the process parameters, materials, and dimensions are given by way of example only. The parameters, materials, and dimensions can be varied to achieve the desired structure as well as modifications, which are within the scope of the claims. For example, although particular types of fan expansion structures and techniques are illustrated and described, any suitable fan flow obstruction device or component may be used. Similarly, various simple multiple-fan arrangements are shown to facilitate expression of the structures and techniques. Any suitable number and arrangement of fans may be used and remain within the scope of the description.

In the claims, unless otherwise indicated the article "a" is to refer to "one or more than one".

What is claimed is:

1. A method for operating a cooling fan in an electronic system comprising:

rotating a fan member whereby an axial airflow pathway is generated;

spatially expanding the fan member in response to slowing or termination of the fan member rotation;

rotating a plurality of fan blades, the individual fan blades configured as multiple-blade electromagnetic segments;

detecting rotation speed of the fan blade plurality; and passing current through the electromagnetic segments in a direction that causes the plurality of fan blades to mutually attract when the rotation speed is higher than a preselected value and to otherwise mutually repel.

2. A method for operating a cooling fan in an electronic system comprising:

rotating a fan member whereby an axial airflow pathway is generated;

spatially expanding the fan member in response to slowing or termination of the fan member rotation;

rotating a plurality of fan blades, the individual fan blades configured as two or more blade members and a flexible membrane coupled between the blade members;

detecting rotation speed of the fan blade plurality;

converging the two or more blade members when the rotation speed is above a preselected value; and separating the two or more blade members when rotation speed is below or equal to the preselected value.

3. A method for operating a cooling fan in an electronic system comprising:

rotating a fan member whereby an axial airflow pathway is generated;

spatially expanding the fan member in response to slowing or termination of the fan member rotation;

directing airflow through the axial airflow pathway using a plurality of airflow stabilizer members coupled to a stationary member of the fan;

detecting rotation speed of the fan blade plurality;

contracting the air stabilizer members when the rotation speed is above a preselected value; and expanding the airflow stabilizer members when rotation speed is below or equal to the preselected value whereby air flow through the electronics cooling fan is constricted.

4. A method for operating a cooling fan in an electronic system comprising:

rotating an impeller about a rotational axis;

detecting fan failure;

spatially expanding the impeller in response to the detected fan failure whereby airflow through the failed fan is blocked;

rotating a plurality of impellers, the individual impellers being configured as multiple-blade electromagnetic segments; and passing current through the electromagnetic segments in a direction that causes the plurality of fan blades to mutually repel when the fan has failed and to otherwise mutually attract.

5. A method for operating a cooling fan in an electronic system comprising:

rotating an impeller about a rotational axis;

detecting fan failure;

spatially expanding the impeller in response to the detected fan failure whereby airflow through the failed fan is blocked;

rotating a plurality of impellers, the individual impellers being configured as two or more impeller members and a flexible membrane coupled between the impeller members; and separating the two or more blade members when fan has failed and otherwise converging the two or more blade members.

6. An apparatus comprising:

an electronics cooling fan in a configuration adapted for rotational motion generating an axial airflow pathway, the electronics cooling fan comprising a member arranged within the axial airflow pathway adapted to spatially expand upon fan failure;

a rotor adapted for rotational motion; and a plurality of fan blades coupled to the rotor, the individual fan blades further comprising multiple blade electromagnetic segments configured to mutually repel upon fan failure detection and otherwise mutually attract.

7. The apparatus according to claim 6 further comprising;

a sensor adapted to detect failure of the electronics cooling fan; and a logic coupled to the sensor and to the electronics cooling fan, the logic being adapted to respond to sensor fan failure detection by activating spatial expansion of the member.

8. The apparatus according to claim 7 further comprising;

a sensor selected from among a group of fan failure detectors consisting of fan current sensors, temperature sensors, tachometer sensors, and electric parameter sensors.

9. An apparatus comprising:

an electronics cooling fan in a configuration adapted for rotational motion generating an axial airflow pathway, the electronics cooling fan comprising a member arranged within the axial airflow pathway adapted to spatially expand upon fan failure;

a rotor adapted for rotational motion; and a plurality of fan blades coupled to the rotor, the individual fan blades further comprising two or more blade members and a flexible membrane coupled between the blade members, separation between the two or more blade members being adapted to diverge upon fan failure detection and otherwise converge.

10. The apparatus according to claim 9 further comprising: a sensor adapted to detect failure of the electronics cooling fan; and a logic coupled to the sensor and to the electronics cooling fan, the logic being adapted to respond to sensor fan failure detection by activating spatial expansion of the member.

11. The apparatus according to claim 9 further comprising:

a sensor selected from among a group of fan failure detectors consisting of fan current sensors, temperature sensors, tachometer sensors, and electric parameter sensors.

12. An apparatus comprising:

an electronics cooling fan in a configuration adapted for rotational motion generating an axial airflow pathway, the electronics cooling fan comprising a member arranged within the axial airflow pathway adapted to spatially expand upon fan failure; and an airflow stabilizer adapted to direct airflow through the electronics cooling fan, the airflow stabilizer further comprising a plurality of members coupled to a stationary member of the electronics cooling fan that expand upon fan failure detection, constricting the airflow through the electronics cooling fan, the plurality of members otherwise contracting.

13. The apparatus according to claim 12 further comprising:

a sensor adapted to detect failure of the electronics cooling fan; and a logic coupled to the sensor and to the electronics cooling fan, the logic being adapted to respond to sensor fan failure detection by activating spatial expansion of the member.

14. The apparatus according to claim 12 further comprising:

a sensor selected from among a group of fan failure detectors consisting of fan current sensors, temperature sensors, tachometer sensors, and electric parameter sensors.

15. An apparatus comprising:

an electronics cooling fan in a configuration adapted for rotational motion generating an axial airflow pathway, the electronics cooling fan comprising a member arranged within the axial airflow pathway adapted to spatially expand upon fan failure;

a stator;

a rotor arranged in combination with the stator and adapted for rotational motion; and a plurality of stator blades coupled to the stater, the individual stator blades further comprising a flap pivotally coupled to the stator blade by a hinge pin, the flap being adapted to abut the stator blade when the fan is operational and extend from the stator blade upon fan failure detection.

16. The apparatus according to claim 15 further comprising:

a sensor adapted to detect failure of the electronics cooling fan; and a logic coupled to the sensor and to the electronics cooling fan, the logic being adapted to respond to sensor fan failure detection by activating spatial expansion of the member.

17. The apparatus according to claim 15 further comprising:

a sensor selected from among a group of fan failure detectors consisting of fan current sensors, temperature sensors, tachometer sensors, and electric parameter sensors.

18. An apparatus comprising:

an electronics cooling fan in a configuration adapted for rotational motion generating an axial airflow pathway, the electronics cooling fan comprising a member arranged within the axial airflow pathway adapted to spatially expand when the rotational motion slows or terminates;

a rotor adapted for rotational motion; and a plurality of fan blades coupled to the rotor, the individual fan blades further comprising multiple blade electromagnetic segments configured to mutually attract during rotation and mutually repel when the rotational motion slows or terminates.

19. An apparatus comprising:

an electronics cooling fan in a configuration adapted for rotational motion generating an axial airflow pathway, the electronics cooling fan comprising a member arranged within the axial airflow pathway adapted to spatially expand when the rotational motion slows or terminates;

a rotor adapted fox rotational motion; and a plurality of fan blades coupled to the rotor, the individual fan blades further comprising two or more blade members and a flexible membrane coupled between the blade members, separation between the two or more blade members being adapted to converge during rotation and diverge when the rotational motion slows or terminates.

20. An apparatus comprising:

an electronics cooling fan in a configuration adapted for rotational motion generating an axial airflow pathway, the electronics cooling fan comprising a member arranged within the axial airflow pathway adapted to spatially expand when the rotational motion slows or terminates: and an airflow stabilizer adapted to direct airflow through the electronics cooling fan, the airflow stabilizer further comprising a plurality of members coupled to a stationary member of the electronics cooling fan that contract during rotational motion and expand when the rotational motion slows or terminates, constricting the airflow through the electronics cooling fan.

21. An apparatus comprising:

an electronics cooling fan in a configuration adapted for rotational motion generating an axial airflow pathway, the electronics cooling fan comprising a member arranged within the axial airflow pathway adapted to spatially expand when the rotational motion slows or terminates;

a stator, a rotor arranged in combination with the stator and adapted for rotational motion; and a plurality of stator blades coupled to the stator, the individual stator blades further comprising a flap pivotally coupled to the stator blade by a hinge pin, the flap being adapted to abut the stator blade during rotation and extend from the stator blade when the rotational motion slows or terminates.

22. An electronics cooling apparatus comprising:

a chassis;

a plurality of electronics cooling fans contained within the chassis, the electronics cooling fans being adapted for rotational motion generating an axial airflow pathway, the electronics cooling fan comprising a member arranged within the axial airflow pathway adapted to spatially expand upon fan failure, the plurality of electronics cooling fans comprising:

a rotor adapted for rotational motion; and a plurality of fan blades coupled to the rotor, the individual fan blades further comprising multiple blade electromagnetic segments configured to mutually attract during rotation and mutually repel when the rotational motion slows or terminates.

* * * * *

UNITED STATES PATENT AND TRADEMARK OFFICE

CERTIFICATE OF CORRECTION

PATENT NO. : 7,184,268 B2 
APPLICATION NO. : 11/033083
DATED : February 27, 2007
INVENTOR(S) : Ricardo Espinoza-Ibarra et al.

It is certified that error appears in the above-identified patent and that said Letters Patent is hereby corrected as shown below:

In column 7, line 28, in Claim 3, delete "air" and insert -- airflow --, therefor.

In column 8, line 7, in Claim 7, delete "comprising;" and insert -- comprising: --, therefor.

In column 8, line 15, in Claim 8, delete "comprising;" and insert -- comprising: --, therefor.

In column 9, line 16, in Claim 15, delete "stater," and insert -- stator, --, therefor.

In column 10, line 1, in Claim 19, delete "fox" and insert -- for --, therefor.

In column 10, line 15, in Claim 20, delete "terminates:" and insert -- terminates; --, therefor.

Signed and Sealed this

Eighth Day of September, 2009

David J. Kappos

David J. Kappos
*Director of the United States Patent and Trademark Office*